US005921540A

United States Patent [19]

Acquaviva et al.

[11] Patent Number: 5,921,540

[45] Date of Patent: Jul. 13, 1999

[54] VACUUM CORRUGATION FEEDER WITH A RETRACTABLE CORRUGATOR

[75] Inventors: Thomas Acquaviva, Penfield; William Brant, Rochester, both of N.Y.

[73] Assignee: Xerox Corporation, Stamford, Conn.

[21] Appl. No.: 09/087,946

[22] Filed: Jun. 1, 1998

[51] Int. Cl.[6] ..... B65H 3/14

[52] U.S. Cl. ..... 271/98; 271/104; 271/105

[58] Field of Search ..... 271/98, 97, 94, 271/104, 105, 106, 161

[56] References Cited

U.S. PATENT DOCUMENTS

| | | | |
|---|---|---|---|
| 2,895,552 | 7/1959 | Pomper et al. | 164/68 |
| 2,979,329 | 4/1961 | Cunningham | 271/29 |
| 3,424,453 | 1/1969 | Halbert | 271/35 |
| 4,157,177 | 6/1979 | Strecker | 271/197 |
| 4,268,025 | 5/1981 | Murayoshi | 271/112 |
| 4,269,406 | 5/1981 | Hamlin | 271/108 |
| 4,418,905 | 12/1983 | Garavuso | 271/98 |
| 4,451,028 | 5/1984 | Holmes et al. | 271/11 |
| 4,589,647 | 5/1986 | Roller | 271/94 |
| 5,150,892 | 9/1992 | Shimizu | 271/104 X |
| 5,344,133 | 9/1994 | Jantsch et al. | 271/98 X |

FOREIGN PATENT DOCUMENTS

| | | | |
|---|---|---|---|
| 0361259 | 4/1990 | European Pat. Off. | 271/98 |

*Primary Examiner*—David H. Bollinger
*Attorney, Agent, or Firm*—William A. Henry, II

[57] ABSTRACT

A vacuum corrugation feeder employs a vacuum feedhead working in conjunction with an air knife to feed sheets from the top or bottom of a stack. A retractable corrugator is included in the vacuum feedhead which prevents smearing of coated sheets due to relative motion between sheet surfaces and the corrugator.

20 Claims, 4 Drawing Sheets

VACUUM CORRUGATION FEEDER WITH A RETRACTABLE CORRUGATOR

BACKGROUND OF THE INVENTION

1. Field of the Invention

This invention relates to an electrophotographic printing machine, and more particularly, concerns an improved vacuum corrugation feeder for such a machine.

2. Description of the Prior Art

Present high speed xerographic copy reproduction machines produce copies at a rate in excess of several thousand copies per hour, therefore, the need for a sheet feeder to feed cut copy sheets to the machine in a rapid, dependable manner has been recognized to enable full utilization of the reproduction machine's potential copy output. In particular, for many purely duplicating operations, it is desired to feed cut copy sheets at very high speeds where multiple copies are made of an original placed on the copying platen. In addition, for many high speed copying operations, a document handler to feed documents from a stack to a copy platen of the machine in a rapid dependable manner has also been reorganized to enable full utilization of the machine's potential copy output. These sheet feeders must operate flawlessly to virtually eliminate the risk of damaging the sheets and generate minimum machine shutdowns due to uncorrectable misfeeds or sheet multifeeds. It is in the initial separation of the individual sheets from the sheet stack where the greatest number of problems occur.

Since the sheets must be handled gently but positively to assure separation without damage through a number of cycles, a number of separators have been suggested such as friction rolls or belts used for fairly positive document feeding in conjunction with a retard belt, pad, or roll to prevent multifeeds. Vacuum separators such as sniffer tubes, rocker type vacuum rolls, or vacuum feed belts have also been utilized.

While the friction roll-retard systems are very positive, the action of the retard member, if it acts upon the printed face can cause smearing or partial erasure of the printed material on the document. With single sided documents if the image is against the retard mechanism, it can be smeared or erased. On the other hand, if the image is against the feed belt it smears through ink transfer and offset back to the paper. However, with documents printed on both sides the problem is compounded. Additionally, the reliable operation of friction retard feeders is highly dependent on the relative frictional properties of the paper being handled. This cannot be controlled in a document feeder.

One of the sheet feeders best known for high speed operation is the top vacuum corrugation feeder with front air knife. In this system, a vacuum plenum with a plurality of friction belts arranged to run over the vacuum plenum is placed at the top of a stack of sheets in a supply tray. At the front of the stack, an air knife is used to inject air into the stack to separate the top sheet from the remainder of the stack. In operation, air is injected by the air knife toward the stack to separate the top sheet, the vacuum pulls the separated sheet up and acquires it. Following acquisition, the belt transport drives the sheet forward off the stack of sheets. In this configuration, separation of the next sheet cannot take place until the top sheet has cleared the stack. In this type of feeding system every operation takes place in succession or serially and therefore the feeding of subsequent sheets cannot be started until the feeding of the previous sheet has been completed. In addition, in this type of system the air knife may cause the second sheet to vibrate independent of the rest of the stack in a manner referred to as "flutter". When the second sheet is in this situation, if it touches the top sheet, it may tend to creep forward slightly with the top sheet. The air knife then may drive the second sheet against the first sheet causing a shingle or double feeding of sheets. Also, current top and bottom vacuum corrugation feeders utilize a valved vacuum feedhead, e.g., U.S. Pat. No. 4,269,406 which is included herein by reference. At the appropriate time during the feed cycle the valve is actuated, establishing a flow and hence a negative pressure field over the stack top or bottom if a bottom vacuum corrugation feeder is employed. This field causes the movement of the top sheet(s) to the vacuum feedhead where the sheet is then transported to the take away rolls. Once the sheet feed edge is under control of the take away rolls, the vacuum is shut off. The trail edge of this sheet exiting the feedhead area is the criteria for again activating the vacuum valve for the next feeding.

While vacuum corrugation feeders are a vast improvement over feeders relying on friction to separate and feed sheets, a smear problem is sometimes noticed when feeding coated stock due to sheets being drawn against a sheet corrugator and rubbed against the sheet corrugator as the sheet is fed for further processing. Hence, the need for a vacuum corrugation feeder that feeds sheet without smearing the coating on coated stock.

PRIOR ART

U.S. Pat. No. 2,979,329 (Cunningham) describes a sheet feeding mechanism useful for both top and bottom feeding of sheets wherein an oscillating vacuum chamber is used to acquire and transport a sheet to be fed. In addition, an air blast is directed to the leading edge of a stack of sheets from which the sheet is to be separated and fed to assist in separating the sheets from the stack.

U.S. Pat. No. 3,424,453 (Halbert) illustrates a vacuum sheet separator feeder with an air knife wherein a plurality of feed belts with holes are transported about a vacuum plenum and pressurized air is delivered to the leading edge of the stack of sheets. This is a bottom sheet feeder.

U.S. Pat. No. 2,895,552 (Pomper et al.) illustrates a vacuum belt transport and stacking device wherein sheets which have been cut from a web are transported from the sheet supply to a sheet stacking tray. Flexible belts perforated at intervals are used to pick up the leading edge of the sheet and is release the sheet over the pile for stacking.

U.S. Pat. No. 4,157,177 (Strecker) illustrates another sheet stacker wherein a first belt conveyor delivers sheets in a shingled fashion and the lower reach of a second perforated belt conveyor which is above the top of the stacking magazine attracts the leading edge of the sheets. The device has a slide which limits the effect of perforations depending on the size of the shingled sheet.

U.S. Pat. No. 4,268,025 (Murayoshi) describes a top sheet feeding apparatus wherein a sheet tray has a vacuum plate above the tray which has a suction hole in its bottom portion. A feed roll in the suction hole transports a sheet to a separating roll and a frictional member in contact with the separating roll.

U.S. Pat. No. 4,418,905 (Garavuso) shows a bottom vacuum corrugation feeding system.

U.S. Pat. No. 4,451,028 (Holmes et al.) discloses a top feed vacuum corrugation feeding system that employs front and back vacuum plenums.

U.S. Pat. No. 4,589,647 (Roller) shows a top vacuum corrugation feeding system.

The above-mentioned patents are included herein by reference to the extent necessary to practice the present invention.

SUMMARY OF THE INVENTION

It is an object of the present invention to provide an improved sheet separator feeder.

It is an additional object of the present invention to provide an improved high speed sheet separator feeder with significant smear reduction. These and other objects are attained with a sheet feeding apparatus comprising a stack tray for supporting a stack of sheets to be fed; at least one endless vacuum belt for acquiring and advancing a sheet from the stack, said at least one vacuum belt extending across a support surface having vacuum ports therein for positioning a negative pressure at the back of said at least one vacuum belt; an air knife positioned in front of the stack tray for applying air pressure to the sheets in the stack tray to separate the sheet nearest said vacuum belt from the next adjacent sheet; a vacuum source for applying a uniform negative pressure to said vacuum ports during the feeding of sheets from the stack tray; and a retractable sheet corrugator adapted for positioning in a sheet contacting position when the sheet is initially acquired by said vacuum belt and subsequently moved to a sheet non-contacting position in order to control smearing.

For a better understanding of the invention as well as other objects and further features thereof, reference is made to the following drawings and descriptions.

DESCRIPTION OF THE PREFERRED EMBODIMENT

While the present invention will be described hereinafter in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
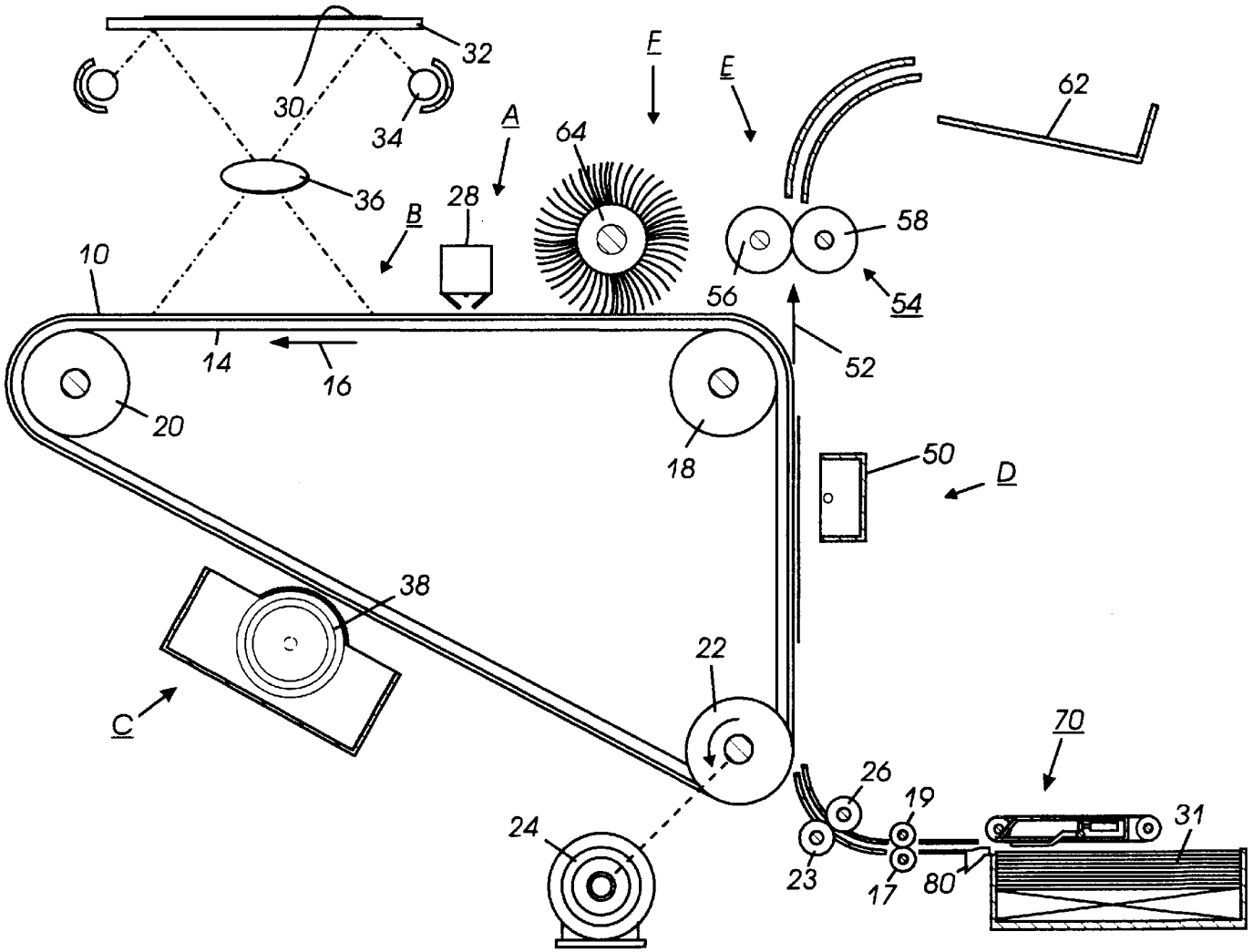
FIG. 1 is a schematic elevational view of an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the top feed vacuum corrugation feeder method and apparatus of the present invention therein. It will become evident from the following discussion that the sheet feeding system disclosed herein is equally well suited for use in a wide variety of devices and is not necessarily limited to its application to the particular embodiment shown herein. For example, the apparatus of the present invention may be readily employed in nonxerographic environments and substrate transportation in general.

Inasmuch as the art of electrophotographic printing is well known, the various processing stations employed in the FIG. 1 printing machine will be shown hereinafter schematically and the operation described briefly with reference thereto.

As shown in FIG. 1, the electrophotographic printing machine employs a belt 10 having a photoconductive surfaced 12 deposited on a conductive substrate 14. Preferably, photoconductive surface 12 is made from a selenium alloy with conductive substrate 14 being made from an aluminum alloy. Belt 10 moves in the direction of arrow 16 to advance successive portions of photo-conductive surface 12 sequentially through the various processing stations disposed about the path of movement thereof. Belt 10 is entrained around stripper roller 18, tension roller 20, and drive roller 22.

Drive roller 22 is mounted rotatably in engagement with belt 10. Roller 22 is coupled to a suitable means such as motor 24 through a belt drive. Motor 24 rotates roller 22 to advance belt 10 in the direction of arrow 16. Drive roller 22 includes a pair of opposed spaced flanges or edge guides (not shown). Preferably, the edge guides are circular members or flanges.

Belt 10 is maintained in tension by a pair of springs (not shown), resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges photoconductive surface 12 of the belt 10 to a relatively high, substantially uniform potential.

Next, the charged portion of photoconductive surface 12 is advanced through exposure station B. At exposure station B, an original document 30 is positioned face down upon transparent platen 32. Lamps 34 flash light rays onto original document 30. The light rays reflected from the original document 30 are transmitted through lens 36 from a light image thereof. The light image is projected onto the charged portion of the photoconductive surface 12 to selectively dissipate the charge thereon. This records an electrostatic latent image on photoconductive surface 12 which corresponds to the information areas contained within original document 30.

Thereafter, belt 10 advances the electrostatic latent image recorded on photoconductive surface 12 to development station C. At development station C, a magnetic brush developer roller 38 advances a developer mix into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material is moved into contact with the toner powder image. The sheet support material is advanced toward transfer station D by top vacuum corrugation feeder 70. Preferably, the feeder includes an air knife 80 which floats a sheet 31 up to where it is grabbed by the suction force from vacuum plenum 75. A perforated feed belt 71 then forwards the now separated sheet for further processing, i.e., the sheet is directed through rollers 17, 19, 23 and 26 into contact with the photoconductive surface 12 of belt 10 in a timed sequence by suitable conventional means so that the toner powder image developed thereon synchronously contacts the advancing sheet of support material at transfer station D.

Transfer station D includes a corona generating device 50 which sprays ions onto the backside of a sheet passing through the station. This attracts the toner powder image from the photoconductive surface 12 to the sheet and provides a normal force which causes photo-conductive surface 12 to take over transport of the advancing sheet of support material. After transfer, the sheet continues to move in the direction of arrow 52 onto a conveyor (not shown) which advances the sheet to fusing station E.

Fusing station E includes a fuser assembly, indicted generally by the reference number 54, which permanently affixes the transferred toner powder image to the substrate. Preferably, fuser assembly 54 includes a heated fuser roller 56 and a backup roller 58. A sheet passes between fuser roller 56 and backup roller 58 with the toner powder image contacting fuser roller 56. In this manner, the toner powder image is permanently affixed to the sheet. After fusing, chute 60 guides the advancing sheet to catch tray 62 for removal from the printing machine by the operator.

After the sheet support material is separated from the photoconductive surface 12 of belt 10, some residual particles may remain adhered thereto. These residual particles are removed from photoconductive surface 12 at cleaning station F. Cleaning station F includes a rotatably mounted brush 64 in contact with the photoconductive surface 12. The particles are cleaned from photoconductive surface 12 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive image cycle.

Figure 2:
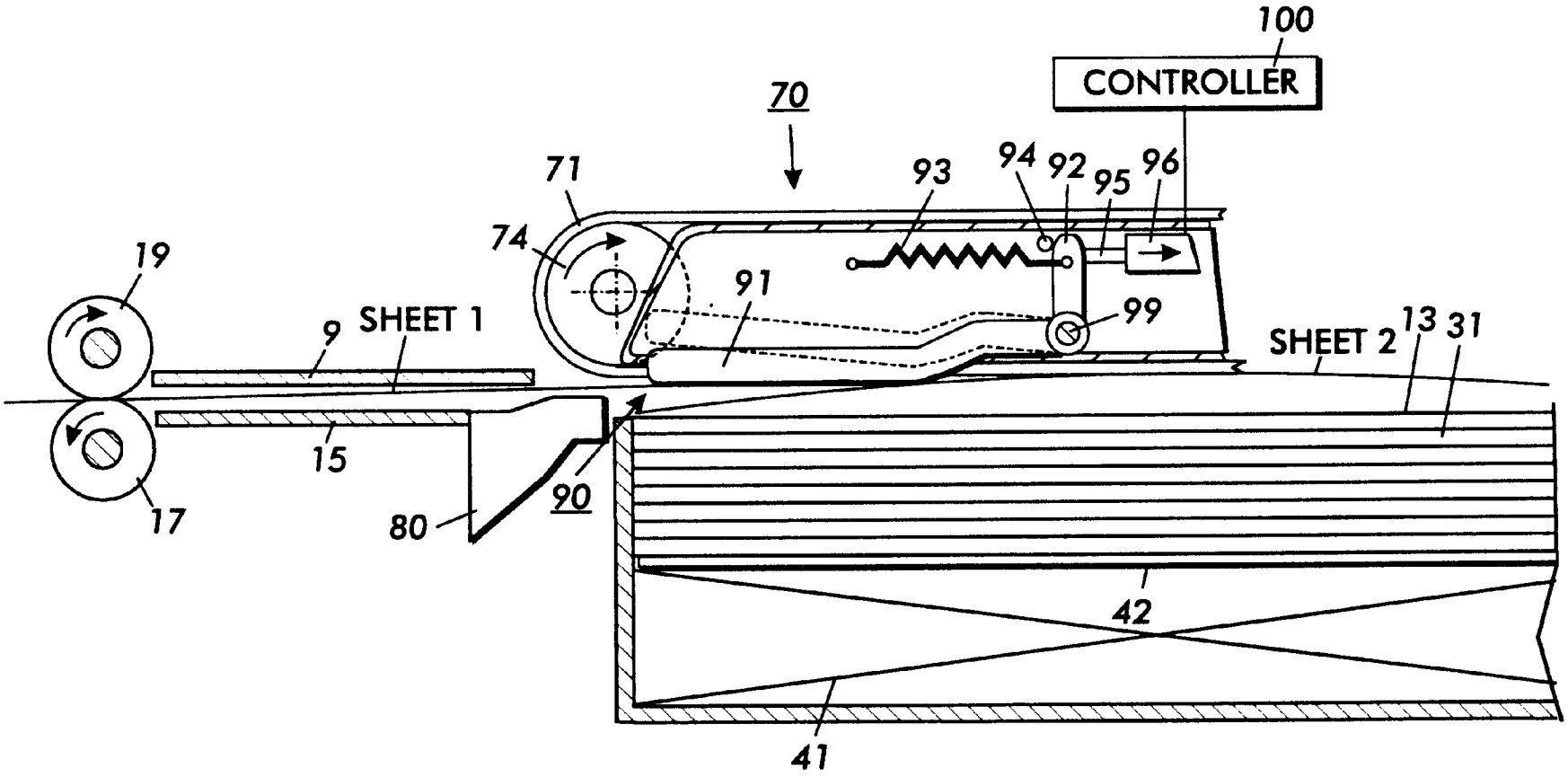
FIG. 2 is an enlarged cross-sectional view of the exemplary feeder in FIG. 1 which employs the retractable sheet corrugator of the present invention.
Figure 3:
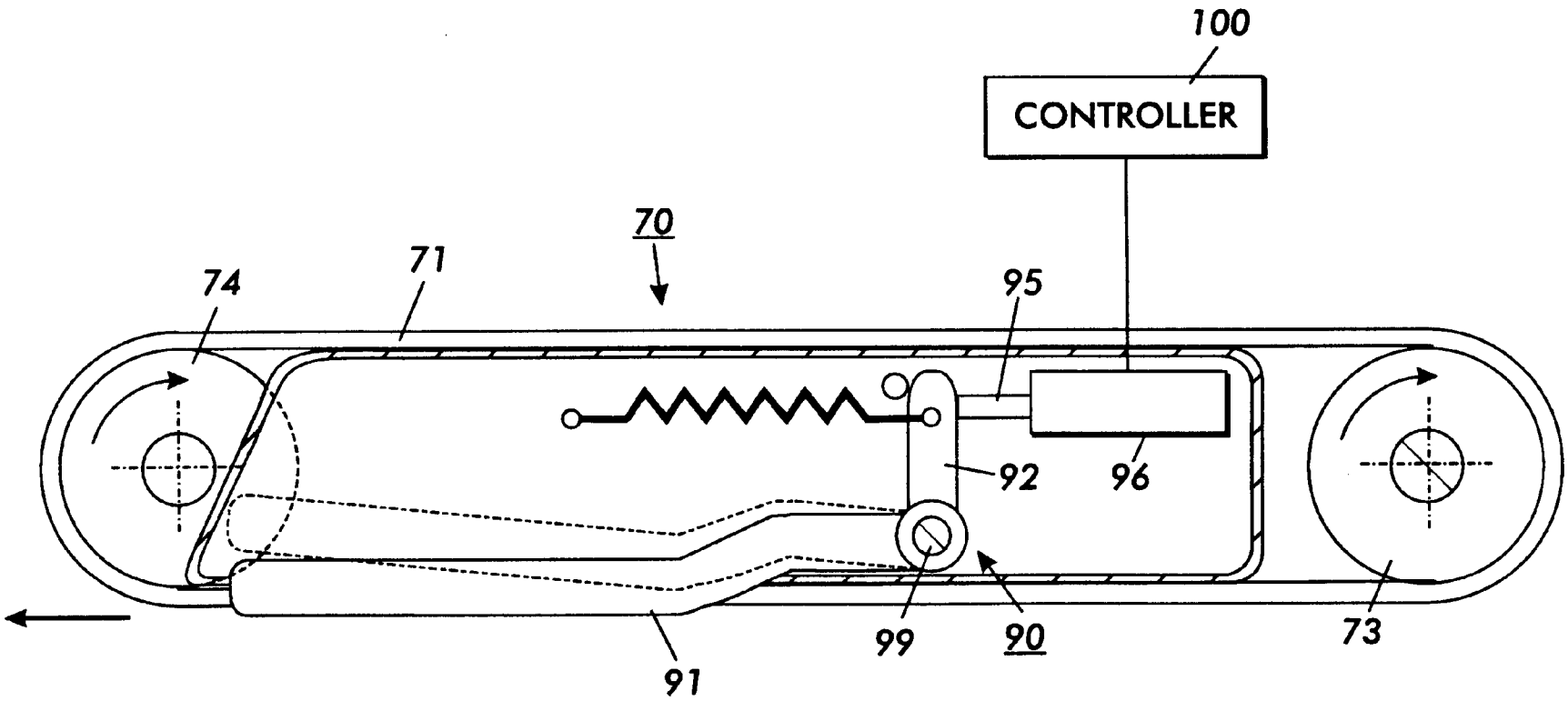
FIG. 3 is an enlarged, partial side view of the vacuum feed mechanism of the feeder of FIG. 2 showing a solenoid operated retractable sheet corrugator.

Referring now to a particular aspect of the present invention, FIGS. 2 and 3 show a system employing an embodiment of the present invention in a copy sheet feeding mode. Alternatively, or in addition, the sheet feeder may be mounted for feeding document sheets to the platen of a printing machine. The sheet feeder is provided with a conventional elevator mechanism 41 for raising and lowering either tray 40 or a platform 42 within tray 40. Ordinarily, a drive motor is actuated to move the sheet stack support platform 42 vertically by a stack height sensor positioned above the rear of the stack when the level of sheets relative to the sensor falls below a first predetermined level. The drive motor is deactuated by the stack height sensor when the level of the sheets relative to the sensor is above a predetermined level. In this way, the level of the top sheet in the stack of sheets may be maintained within relatively narrow limits to assure proper sheet separation, acquisition and feeding.

Vacuum corrugation feeder 70 and a vacuum plenum 75 are positioned over the front end of a tray 40 having copy sheets 31 stacked therein. Belts 71 are entrained around drive roller 74 and idler roller 73, as well as, plenum 75. Belts 71 could be made into a single belt, if desired. Perforations 72 in the belts allow a suitable vacuum source (not shown) to apply a vacuum through plenum 75 and belts 71 to acquire sheets 31 from stack 13. Air knife 80 with applies a positive pressure to the front of stack 13 to separate the top sheet in the stack and enhance its acquisition by vacuum plenum 75. A suitable air knife that could be used in the present invention is disclosed in commonly assigned U.S. Pat. No. 4,418,905 entitled sheet Feeding Apparatus, and is incorporated herein by reference. In accordance with the preferred embodiment of the present invention, retractable corrugation member 91 protrudes beyond the underside of plenum 75 and causes sheets acquired by the vacuum plenum to bend during corrugation so that if a second sheet is still sticking to the sheet having been acquired by the vacuum plenum, the corrugation will cause the second sheet to detach and fall back into the tray. A sheet captured on belts 71 is forwarded through baffles 9 and 15 and into forwarding drive rollers 17 and 19 for transport to transfer station D.

Sheet acquisition, increased reliability and decreased minimum feed speed, is obtained with vacuum plenum 75 that is equipped with a negative pressure source that is ON continuously during the feed cycle, with the only criteria for sheet feeding being that the motion of vacuum feedhead 70 is ceased prior to the trail edge of the acquired sheet exposing all of the vacuum ports. The next sheet is then acquired in a "travelling wave" fashion as shown in FIG. 2.

As can be seen in FIG. 2, the ripple in sheet 2 makes for a more reliable feeder since the concavity of the sheet caused by continuously operating vacuum plenum 75 will increase the unbuckling of sheet 3 from sheet 2. Sheet 3 will have a chance to settle down against the stack before sheet 2 is fed since air knife 80 has been turned off. Belts 71 are stopped just before sheet 1 uncovers the vacuum plenum completely in order to enhance the dropping of any sheets that are tacked to sheet 2 back down upon the stack and to feed the sheets in time with images produced on the photoreceptor. When a signal is received from a conventional controller to feed another sheet, belts 71 are turned in a clockwise direction to feed sheet 2. Knife 80 is also turned ON and applies air pressure to the front of the stack to insure separation of sheet 2 from any other sheets and assist the vacuum plenum in lifting the front end of the sheet up against retractable corrugation member 91 which is an additional means of insuring against multi-sheet feeding. Lightweight flimsy sheet feeding is enhanced with this method of feeding since sheet 2 is easily adhered to the vacuum plenum while sheet 1 is being fed by transport rollers 17 and 19. Also, gravity will conform the front and rear portions of sheet 2 against the stack while the concavity produced in the sheet by the vacuum plenum remains.

Referring more particularly to FIG. 3, there is disclosed a plurality of feed belts 71 supported for movement on rollers 73 and 74. Spaced within the run of belts 71 there is provided a vacuum plenum 75 having an opening therein adapted for cooperation with perforations 72 in the belts to provide a vacuum for pulling the top sheet in the stack onto the belts 71. A retractable corrugator mechanism 90 has a retractable corrugation member 91 that is positioned in a first sheet corrugating position to project below the surface of vacuum plenum 75 so that upon capture of the top sheet in the stack by the belts a corrugation will be produced in the sheet. The flat surfaces of the vacuum belts on each side of projecting member 92 of the vacuum plenum generates a region of maximum stress in the sheet which varies with the beam strength of the sheet. In the unlikely event more than one sheet is pulled to the belts, second sheet resists the corrugation action, thus gaps are opened between sheets one and two which extend to their lead edges. The gaps and channels reduce the vacuum levels between sheets one and two due to porosity in sheet one and provide for entry of the separating air flow of the air knife 80.

Retractable corrugator 90 is positioned within vacuum plenum 75 and includes a retractable corrugation member 91 pivotally mounted on shaft 99 and biased to a protruding and sheet corrugating position by a spring 93 connected to extension member 92 that extends orthogonally from retractable corrugation member 91. A stop 94 prevents retractable corrugation member 91 from protruding an unacceptable distance beyond the lower surface of vacuum plenum 74. A solenoid 96 which is controlled by machine controller 100 is connected through shaft 95 to extension member 92 and is adapted to remove retractable corrugation member 91 from contact with sheets that have been drawn against vacuum plenum 75. When the acquisition and feed cycle is completed, solenoid 96 operates in response to a signal from controller 100 and retractable corrugation member 91 is retracted behind feed belts 71. Since the acquired sheet has already been separated from the stack, one option is to turn off the air knife while the sheet is being fed by the take away rolls. After the sheet leaves the feed tray, the solenoid is de-energized and the retractable member moves down for the next sheet feed. This sequence removes any chance for relative motion between the sheet surface and a stationary retractable member. That is, retractable corrugation member 91 is moved out of the feed path after a sheet is acquired and separated from the rest of the stack. Retraction can occur before a sheet is fed or when the feed belt starts to move. In either case, smearing of the surface of a coated sheet is significantly diminished.

Figure 4:
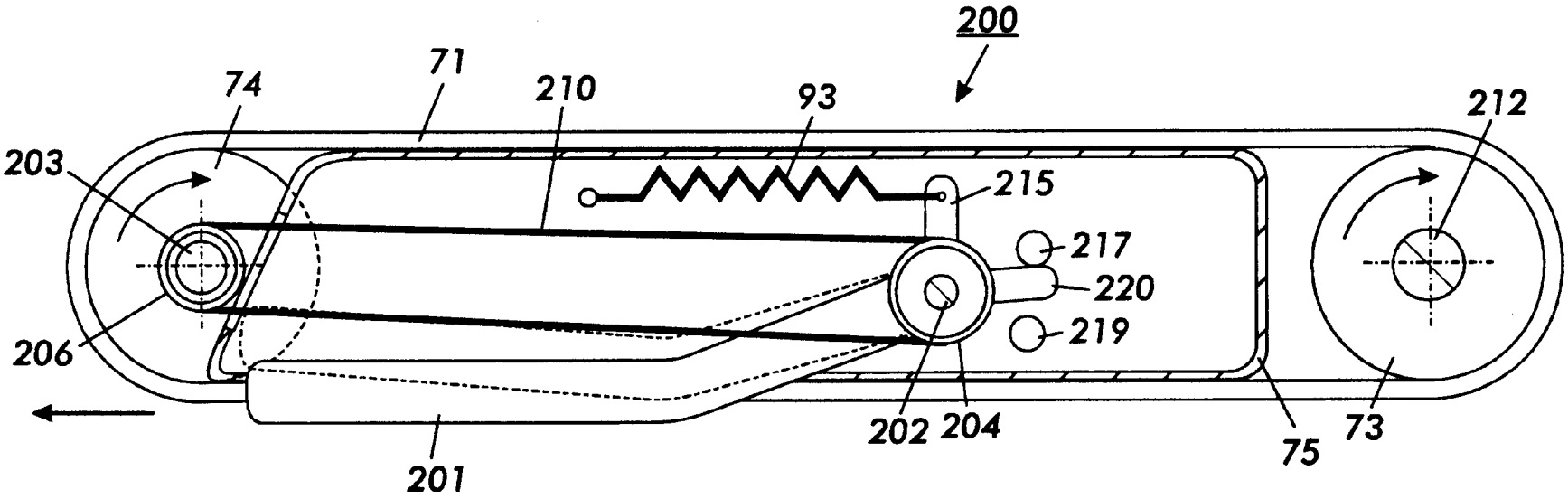
FIG. 4 is an enlarged, partial side view of the vacuum feed mechanism of the feeder of FIG. 2 showing a friction driven retractable sheet corrugator.

An alternative embodiment of the present invention is shown in FIG. 4, and comprises a corrugation mechanism 200 that includes a friction driven corrugation system. The friction drive corrugation system includes a friction drive pulley 204 that transmits power to retractable corrugator 201 through a corrugator drive belt 210 which is entrained around roller 206 mounted on shaft 203 that supports for rotation drive roller 74. A spring 93 connected to retractable extension member 215 of retractable corrugator 201 biases retractable corrugator 201 into a plane below the lower surface of plenum 75 such that sheets drawn to plenum 75 are contacted by the corrugator member. A stop 217 defines the lower limit of movement of retractable corrugator member 201 and stop 219 defines the upper movement limit of retractable corrugator member 201 with respect to movement out of the path of sheets drawn against perforated belts 71. When the acquisition cycle is completed, the friction system is turned ON when drive roller 73 is actuated and retractable corrugation member 201 is retracted behind the feed belts. When the feed cycle is completed and the belts 71 are stopped, retractable corrugation member 201 drops down in place for the next sheet.

It should now be apparent that the separation capability of the vacuum corrugation feeder disclosed herein is highly capable of feeding coated sheet without smearing. This is due to the fact that the present invention is directed to eliminating relative motion between sheet surfaces and a sheet corrugator. The corrugator is retracted before or during the feed-out cycle, thus preventing burnishing of coated sheet surfaces without adversely affecting performance with other coated or non-coated sheets. Also, multiple sheet corrugators can be used, if desired, without deletrious effects.

In addition to the method and apparatus disclosed above, other modifications and/or additions will readily appear to those skilled in the art upon reading this disclosure and are intended to be encompassed within the invention disclosed and claimed herein.

We claim:

1. A high speed sheet separator-feeder for separating and forwarding sheets seriatim from a stack of sheets, comprising:

a stack tray for supporting a stack of sheets to be fed;

at least one endless vacuum belt for acquiring and advancing a sheet from the stack, said at least one vacuum belt extending across a support surface having vacuum ports therein for positioning a negative pressure at the back of said at least one vacuum belt;

an air knife positioned in front of the stack tray for applying air pressure to the sheets in the stack tray to separate the sheet nearest said vacuum belt from the next adjacent sheet;

a vacuum source for applying a uniform negative pressure to said vacuum ports during the feeding of sheets from the stack tray; and a retractable sheet corrugator adapted for positioning in a sheet contacting position when the sheet is initially acquired by said vacuum belt and subsequently moved to a sheet non-contacting position.

2. The high speed sheet separator-feeder of claim 1, wherein said retractable sheet corrugator is moved to a sheet non-contacting position after each sheet is acquired by said vacuum belt.

3. The high speed sheet separator-feeder of claim 1, wherein said retractable sheet corrugator is retracted to a sheet non-contacting position when said at least one vacuum belt initiates advancement of each sheet.

4. The high speed sheet separator-feeder of claim 1, wherein said retractable sheet corrugator is retracted to a sheet non-contacting position by a solenoid.

5. The high speed sheet separator-feeder of claim 1, wherein the stack of sheets includes coated sheets.

6. The high speed sheet separator-feeder of claim 1, including multiple retractable sheet corrugators.

7. The high speed sheet separator-feeder of claim 1, including a belt drive mechanism for driving said endless vacuum belt, and wherein said retractable sheet corrugator is retracted by said belt drive mechanism.

8. The high speed sheet separator-feeder of claim 1, wherein said belt drive mechanism includes two mechanical stops defining upward and downward movement of said retractable sheet corrugator.

9. The high speed sheet separator-feeder of claim 8, wherein said retractable sheet corrugator is spring loaded in a down position.

10. A high speed top sheet separator-feeder apparatus for separating and forwarding substrates, including coated substrates, in seriatim, comprising:

a substrate support for supporting a stack of substrates, said substrate support having front, rear and side walls attached thereto, said rear and side walls overlapping the top of the stack of substrates;

an air knife located at the front of the stack of substrates and adapted to apply air pressure to the stack of substrates in order to separate the top substrate of the stack from the next adjacent substrate;

a vacuum plenum in position above the stack of substrates for applying a vacuum with force sufficient to acquire the top substrate from the stack;

a substrate corrugator for corrugating substrates fed from the stack; and at least one perforated belt entrained over said vacuum plenum and adapted to forward the substrates after they have been acquired by said vacuum plenum; and wherein said substrate corrugator is multi-positionable such that in a first position it corrugates the substrates acquired by said vacuum plenum and in a second position is removed from contact with the substrates.

11. The high speed top sheet separator-feeder of claim 10, wherein said substrate corrugator is moved to a sheet non-contacting position after each substrate is acquired by said perforated belt.

12. The high speed top sheet separator-feeder of claim 10, wherein said substrate corrugator is positioned in said sheet non-contacting position when said at least one perforated belt initiates advancement of each substrate.

13. The high speed top sheet separator-feeder of claim 12, wherein said substrate corrugator is positioned in said sheet non-contacting position by a solenoid.

14. The high speed top sheet separator-feeder of claim 10, including multiple substrate corrugators.

15. A high speed vacuum corrugation feeder for feeding sheets seriatim from a stack of sheets, comprising:

a stack tray for supporting a stack of sheets to be fed;

a vacuum plenum having vacuum ports therein and adapted to apply a negative pressure to sheet in said stack tray through said vacuum ports, a plurality of perforated endless belts surrounding said vacuum plenum for advancing a sheet from the stack acquired thereto by said vacuum plenum;

an air knife positioned in front of the stack tray for applying air pressure to the sheets in the stack tray to separate a sheet closest to said endless belts from the next adjacent sheet; and a retractable sheet corrugator adapted for positioning in a sheet contacting position when a sheet is initially acquired by said vacuum plenum and then subsequently moved to a sheet non-contacting position.

16. The high speed vacuum corrugation feeder of claim 15, wherein said retractable sheet corrugator is moved to a sheet non-contacting position after each substrate is acquired by said endless belts.

17. The high speed vacuum corrugation feeder of claim 15, wherein said retractable sheet corrugator is positioned in said sheet non-contacting position when said at least one perforated belt initiates advancement of each substrate.

18. The high speed vacuum corrugation feeder of claim 17, wherein said retractable sheet corrugator is positioned in said sheet non-contacting position by a solenoid.

19. The high speed vacuum corrugation feeder of claim 15, including multiple retractable sheet corrugators.

20. The high speed vacuum corrugation feeder of claim 15, including a belt friction drive mechanism for driving said endless belts, and wherein said retractable sheet corrugator is retracted by said belt drive mechanism.

* * * * *